United States Patent [19]

Pfeil

[11] Patent Number: 4,657,480

[45] Date of Patent: Apr. 14, 1987

[54] VARIABLE CONTROL MECHANISM

[75] Inventor: Horst Pfeil, Darmstadt, Fed. Rep. of Germany

[73] Assignee: Aktiengesellschaft Kühnle, Kopp & Kausch, Frankenthal, Fed. Rep. of Germany

[21] Appl. No.: 629,601

[22] Filed: Jul. 11, 1984

[30] Foreign Application Priority Data

Jul. 16, 1983 [DE] Fed. Rep. of Germany ..... 3325756

[51] Int. Cl.[4] ..... F01D 17/16

[52] U.S. Cl. ..... 415/147; 415/164

[58] Field of Search ..... 415/146, 147, 148, 150, 415/156, 157, 159–164, 166

[56] References Cited

U.S. PATENT DOCUMENTS

| | | | |
|---|---|---|---|
| 1,136,877 | 4/1915 | Homersham | 415/146 |
| 3,957,392 | 5/1976 | Blackburn | 415/146 |
| 4,029,433 | 6/1977 | Penny et al. | 415/147 |
| 4,179,247 | 12/1979 | Osborn | 415/163 X |
| 4,484,857 | 11/1984 | Patin | 415/146 |

FOREIGN PATENT DOCUMENTS

| | | | |
|---|---|---|---|
| 518787 | 2/1931 | Fed. Rep. of Germany | 415/164 |
| 889091 | 7/1953 | Fed. Rep. of Germany | 415/160 |
| 964551 | 5/1957 | Fed. Rep. of Germany | 415/164 |
| 2262031 | 6/1974 | Fed. Rep. of Germany | 415/156 |
| 2329022 | 2/1975 | Fed. Rep. of Germany . | |
| 2455361 | 6/1975 | Fed. Rep. of Germany . | |
| 3030079 | 3/1982 | Fed. Rep. of Germany . | |
| 1041161 | 10/1953 | France | 415/160 |
| 24500 | 2/1982 | Japan | 415/160 |
| 304638 | 1/1929 | United Kingdom | 415/146 |
| 731822 | 6/1955 | United Kingdom . | |

*Primary Examiner*—Robert E. Garrett
*Assistant Examiner*—Joseph M. Pitko
*Attorney, Agent, or Firm*—Schwartz, Jeffery, Schwaab, Mack, Blumenthal & Evans

[57] ABSTRACT

A variable control mechanism for a turbine engine, in particular an exhaust gas turbine of a turbocharger, with a ring of guide blades arranged concentrically around a rotor axle and pivoting around pivot axles between end limits. The pivot axles are arranged in the forward areas associated with the inflow edges of the guide blades; one of the end limits being variable by means of an adjusting ring or the like. Clearance and impact losses are incurred depending on the prevailing setting of the guide blades. The invention provides a guide mechanism which can be constructed inexpensively and which reduces clearance and impact losses. The guide blades are arranged such that they can pivot freely within an angular setting range defined by the end limits. In case of a low load the guide blades pivot freely within the predetermined end limits, and with rising loads they abut against the variable end limit.

16 Claims, 6 Drawing Figures

VARIABLE CONTROL MECHANISM

This invention relates to a variable control mechanism for a turbo-engine, in particular an exhaust gas turbine of a turbocharger, with a ring of guide blades arranged concentrically around a rotor axle and pivotable between end limits around pivot axles placed in the forward area of the guide blades associated with the inflow edges, wherein one of the end limits is adjustable by means of an adjusting ring or the like.

BACKGROUND OF THE INVENTION

In DE-OS No. 23 29 022 a variable control mechanism for the guide blades of a gas turbine is described, the guide blades of which are pivotable around pivot axles. To pivot the guide blades, they are provided in the area of their discharge edges with lateral pins which engage axial guide grooves in an adjusting ring. The guide blades may be pivoted between end limit stops by means of the adjusting ring, but the guide blades are not freely pivoting. The guide blades are forcibly guided in each operating range of the gas turbine according to the setting of the adjusting ring.

In DE-OS No. 24 55 361 an adjustable control mechanism of a turbine or compressor is described, wherein the blades are guided on the one hand in a housing and on the other hand in an adjusting ring. The adjusting ring is variable between two stationary stops. The guide blades are thus forcibly guided by mechanical means, which requires a relatively large mechanical effort to mount each guide blade around two pivot axes and to provide an eccentric member, an elongated hole, or the like. Further, external adjusting forces must be applied in two directions to adjust the guide blades.

A turbocharger with a variable control mechanism is described in U.S. Pat. Nos. 4,179,247, wherein the pivot axles of each guide blade are fixedly connected to a lever so that they rotate together. These levers are operatively connected with an adjusting ring provided with an elongated hole or the like, so that as the adjusting ring is rotated, the lever and thus the associated guide blades also rotate accordingly. Thus, in this device forced guidance is again employed, so that adjusting force must be applied in both adjustment directions. The direction of flow of the flow medium is determined by the control mechanism by means of the forced guidance. It has been found that, particularly in the partially loaded state or partial load range of the engine charged by the turbocharger, power consumption is adversely affected by clearance and impact losses.

SUMMARY OF THE INVENTION

It is the object of the present invention to provide a control mechanism of the aforementioned type, having a relatively simple design configuration.

Another object is to provide a variable control mechanism in which the adjusting forces are applied in one direction only.

Yet another object is to provide a control mechanism in which clearance and/or impact losses are reduced in order to obtain a low power consumption.

A further object is to provide a control mechanism which enables the adjusting force to be applied to the adjusting ring in a simple manner and at any point that may be desired.

It is also an object of the invention to provide a control mechanism with a compact and weight saying configuration and a high degree of operational safety.

Furthermore, in addition to the reduced weight, the control mechanism should be functionally adaptable to operating requirements and the conditions of installation.

These and other objects are achieved by providing a variable control mechanism for a turbine engine having a ring of guide blades arranged concentrically around a rotor axle, said guide blades being pivotable between end limits around pivot axles at the forward parts of the guide blades associated with the inflow edges, said guide mechanism comprising means for varying one of said end limits, and said guide blades being freely pivotable under the influence of applied flow forces within an angular range defined by said end limits.

Thus, it is proposed to arrange the guide blades so that they are freely pivotable under the effect of the flow forces within an adjustment angle range determined by the end limits, one of which is adjustable. The control mechanism of the invention has a comparatively simple design configuration, and the adjusting forces are applied in one direction only. Within the limits determinend by the end stops, during normal operation and in the partial load state, the guide blades are set automatically in accordance with the direction of the flow lines. In this manner an appreciable reduction of clearance and impact losses is obtained in the partial load range, when only a slight or no charging pressure is required for the engine. In this operating range the freely pivoting guide blades adjust themselves for "minimum loss", without requiring a large control and regulating effort, as in the case of forcibly controlled guide blades. It should be noted further that in the case of increased charging pressures, results identical with those of fully controlled guide blades are obtained. The control mechanism offers high operating reliability together with a simple configuration, wherein the adjusting force may be introduced at any point desired. The invention may be adapted without difficulty to existing installation conditions. An important feature is that the pivoting guide blades are not adjusted by means of an external torque applied to their pivot axles, but that in the partial load range they pivot freely between variable end limits. On the other hand, in case of increased loading the guide blades are rotated to the largest possible angle permitted by the end limit, such rotation being effected by the blade forces applied by the flow and acting between the pivot axle and the variable limit. The end limit may be set, in the case of a turbocharger for example, in keeping with the turbo-boost pressure characteristic. It goes without saying that in different turbine engines, adjustability may be provided according to parameters that are appropriate in the particular case. It is readily apparent that in view of the adjustability in accordance with preselected parameters, optimum adaptation to prevailing requirements and operating conditions is possible.

In one particular embodiment, the guide blades have a lateral guide pin sliding in an adjustable guide groove. It should be noted that by means of the aforementioned adjusting ring, the guide groove may be adjusted as deisred. Due to the lateral position of the pin, the passage between the guide blades remains free.

In an alternative embodiment an adjustable guide pin is provided in the wall of the flow channel, which pin slides in a guide groove provided on the frontal side of the guide blades or on the downstream side of the blade profile. In this embodiment the guide pin, which advantageously is directly connected with the adjusting ring, forms a reliable support or limit for the guide blades, whereby here again a relatively low manufacturing cost is required.

In one particular embodiment of the invention, a rotatable adjusting ring for a centripetal flow rotor is provided with saw tooth shaped support surfaces for the free ends of the guide blades. The saw tooth shaped support surfaces according to the invention are spaced a lesser distance from the rotor axis than the pivot axles. The curve configuration may be prescribed according to the existing requirements. Advantageously, the curves are laid out so that a defined adjustment angle of the blade is associated with an adjusting angle of the adjusting ring, whereby even a linear dependence may be achieved without difficulty.

In another embodiment for an axial flow rotor, the free ends of the guide blades rest in part on an axially displaceable adjusting ring arranged in the flow channel. In this embodiment the adjusting ring is also located behind the pivot axles in the direction of flow, so that the rotation of the blades effected by the flow forces is limited by the engagement of the free ends of the blades against the adjusting ring.

In an alternative embodiment at least two guide blades are coupled and pivot freely together. The individual guide blades are, therefore, no longer freely pivotable independently of each other, but the groups of coupled guide blades pivot freely together. In the present invention the individual blades are thus joined together in groups distributed around the circumference of the rotor. Consequently, the coupled guide blades have identical angles of incidence, whereby a particularly uniform flow onto the turbine wheel is assured. Furthermore, as the result of the coupling together of different guide blades according to the invention, the detrimental vibration or fluttering that may occur with individual blades under certain conditions, is prevented. Of the total number of guide blades at least two are joined together in a given case, but depending on prevailing requirements more than two blades may also be connected with each other, particularly by means of a lever or the like.

BRIEF DESCRIPTION OF THE DRAWINGS

Preferred embodiments of the invention will be described hereinafter with reference to the accompanying drawings in which.

DETAILED DESCRIPTION OF PREFERRED EMBODIMENTS

Figure 1:
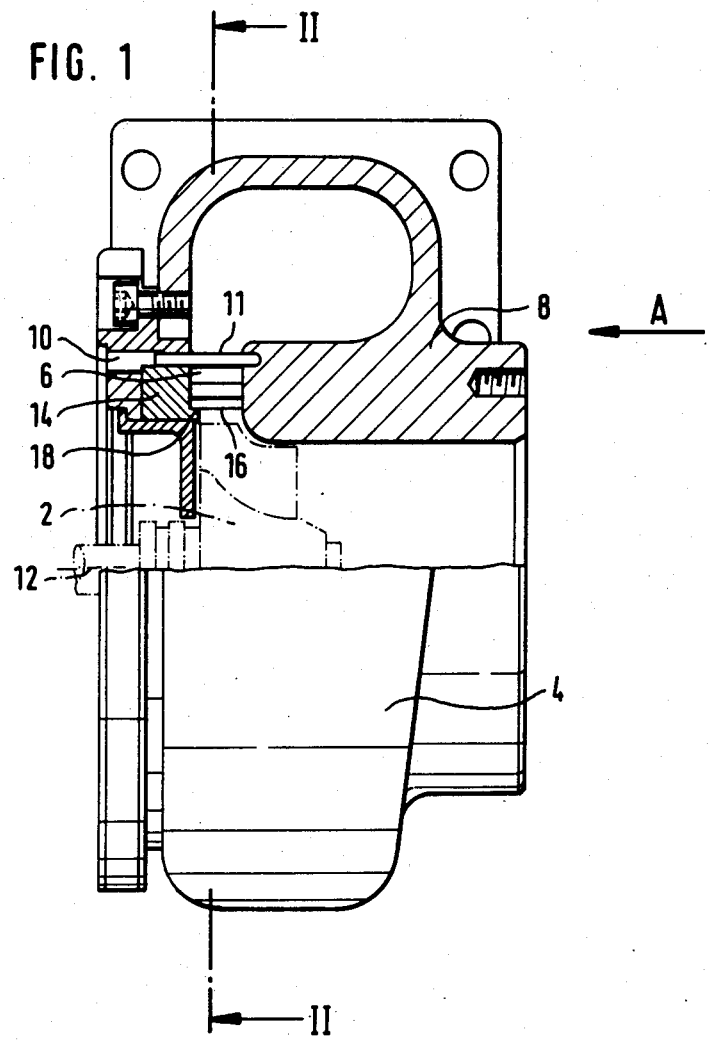
FIG. 1 is a schematic longitudinal section through an exhaust gas turbine.

FIG. 1 shows in a purely schematic manner an exhaust gas turbine with a centripetal flow rotor 2. A helical inflow channel 4 is provided, through which in a conventional manner the radially inwardly flowing exhaust gas arrives at the guide blades 6 arranged in a circumferential distribution. The guide blades 6 are pivotably disposed around a pivot axle 10 in a housing 8, with the pivot axle being located in the area of the inflow edge 11. In the housing 8 an adjusting ring 14, rotatable in an appropriate manner around the rotor axle 12, is further arranged. The guide blades lie with their free, radially inwardly pointing ends 16 on a projection 18 of the adjusting ring 14. The adjusting ring 14, or rather the projection 18, has a saw tooth like contour, to be explained below. Corresponding projections are provided on the adjusting ring for the rest of the guide blades distributed around the circumference. The projections 18 constitute inner limit stops for the guide blades 6, against which the guide blades lie in the case of rising loads. Otherwise, the guide blades pivot freely around their pivot axles 10. By means of suitable adjusting means, which may preferably be pneumatic or also mechanical, the adjusting ring 14 may be rotated to adjust it to the desired angular position with respect to the rotor axle 12.

Figure 2:
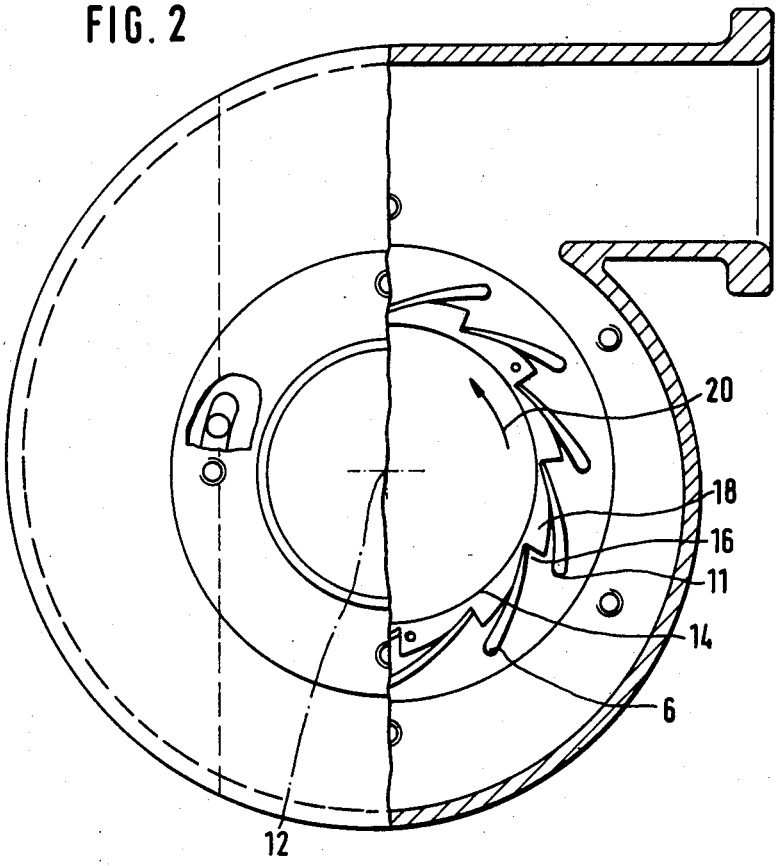
FIG. 2 is a view of the device of FIG. 1 in the direction of arrow "A", partially in section along the line II—II.

FIG. 2 shows at its left side a view in the direction of arrow A and at its right side a section along the line II—II of FIG. 1. The adjusting ring 14 has saw tooth like projections 18 on its radially outer surface with one such projection being provided for each guide blade 6. The drawing shows the position wherein the flow cross section between the guide blades is the largest. By rotating the adjusting ring 14 around the rotor axle 12 in the direction of the arrow 20, the flow cross section is reduced. The free ends 16 of the guide blades 6 move in a radially outward direction along the saw tooth like contour. The adjusting ring 14 configured in this way provides a variable inner end limit for the guide blades 6. In this embodiment of the invention the outer limit is formed by the next guide blade following in the circumferential direction. In the case of a low load, the guide blades 6 adjust themselves between the two limits in accordance with the pressure and flow conditions, whereby clearance and impact losses are reduced to a minimum. Consequently in this partial load range, losses are appreciably lower than in the case of fully controlled guide blades. According to the invention the saw tooth like curves or surfaces of the projections 18 are formed in such a way that a proportional relationship exists between the variation of the angle of rotation of the adjusting ring 14 and the variation of the adjustment angle of the guide blades 6. It is of substantial importance furthermore that in the area of the projections 18 of the adjusting ring 14 and thus in the area of the downstream edges and the free ends of the guide blades 6, there is a narrowing of the flow width.

Figure 3:
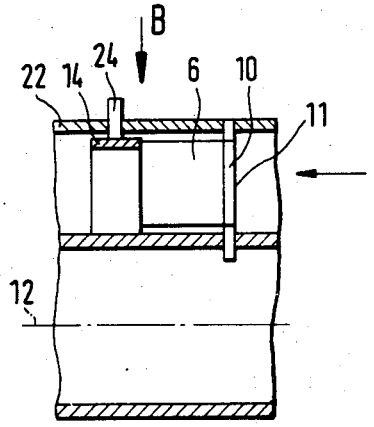
FIG. 3 is a partial representation of an axial section through the guide blades of an axial flow channel.

FIG. 3 shows in a purely schematic manner the control mechanism for an exhaust gas turbine with an axial flow rotor, not shown here in further detail. The adjusting ring 14 may be seen concentric to the rotor axis 12. The adjusting ring 14 is a hollow ring and according to the invention is arranged radially outwardly in the flow channel. Each guide blade 6 is pivotable around a substantially radially directed pivot axis 10 which is located at the front edge, i.e., in the vicinity of the inflow edge. The free ends or downstream edges of the guide blades 6 have a small, radially outward part lying against the frontal surface of the adjusting ring 14. The adjusting ring 14 is guided in an appropriate manner in the housing 22 and is axially adjustable parallel to the rotor axle 12, for example by means of a bolt 24.

Figure 4:
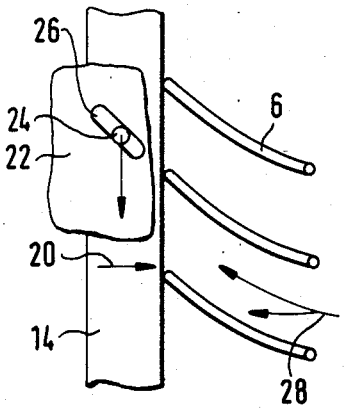
FIG. 4 is a view in the direction of arrow "B", according to FIG. 3, partially projected into the plane of the drawing.

FIG. 4 shows a part of the control mechanism of FIG. 3 viewed in the direction of arrow B. The housing 22 has an inclined slit 26 for the bolt 24, so that when the bolt is moved, not only an axial adjustment of the adjusting ring in the direction of the rotor axis, but also a simultaneous rotation of the ring around the rotor axis will take place. According to the invention, this assures easy setting of the adjusting ring. The guide blades 6 lie, as readily seen in connection with FIG. 3, with the outer parts of their downstream edges against the adjusting ring 14, which thereby forms one end limit. By moving the adjusting ring 14 in the direction of the arrow 20 the end limit is also varied in this embodiment. It goes without saying that the other end limit is constituted by the adjacent guide blade. With rising load pressures, the force component indicated by the arrow 28 of the inflowing medium increases, whereby the guide blades 6 are firmly pressed against the end limit provided by the adjusting ring 14. In case of a low load pressure, i.e., in the partial load range, the aforesaid force component tends toward zero and the guide blades, which according to the invention are freely pivotable between the end limits, adjust themselves automatically to the most favorable angular position. An appreciable reduction of clearance and impact losses is thereby obtained.

Figure 5:
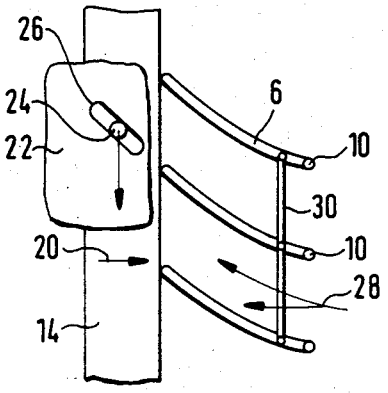
FIG. 5 is a view similar to FIG. 4, in which three guide blades are coupled together by means of a lever.

FIG. 5 shows a view similar to FIG. 4, but wherein the three guide blades 6 shown are coupled together by means of a lever 30. In all other respects, the description of FIG. 4 applies correspondingly to this figure. The three guide blades 6 are coupled together by means of the lever 30 in such a manner such that they pivot together around their pivot axles 10, and thus in the partial load range always assume the same angular position. The rest of the guide blades distributed around the circumference but not shown in the drawing are, of course, also coupled together in groups. In contrast to the embodiments with individually pivotable guide blades, which assume slightly different angular positions as the result of the helical flow, guide blades joined together in this manner always assume the same angular position. The uniformity of the flow onto the turbine rotor is significantly improved, and vibrations of individual blades may be prevented.

Figure 6:
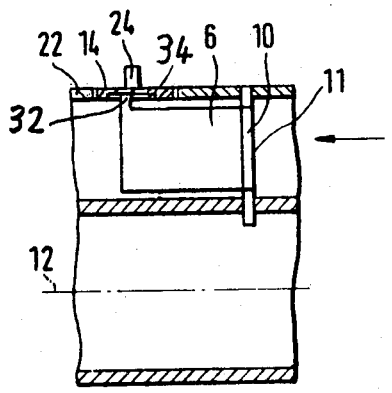
FIG. 6 is a representation similar to FIG. 3.

FIG. 6 shows an other embodiment of the control mechanism. The guide plates 6 have a lateral guide pin 32 sliding in an adjustable guide groove 34 of the adjusting ring 14. The adjusting ring 14 is a hollow ring and it is arranged at the side of the flow channel. As for the rest the description of FIG. 3 is applicable in a corresponding manner.

The foregoing description has been set forth merely to illustrate the invention and is not intended to be limiting. Since modifications of the disclosed embodiments incorporating the spirit and substance of the invention may occur to persons skilled in the art, the scope of the invention is to be limited solely with respect to the following claims and equivalents.

I claim:

1. A variable control mechanism for a turbine engine having a ring of guide blades arranged concentrically around a rotor axle, said guide blades being pivotable between end limits around pivot axles at the forward parts of the guide blades associated with the inflow edges, said control mechanism comprising means for varying one of said end limits, and said guide blades being freely pivotable under the influence of applied flow forces within an angular range defined by said end limits, wherein said means for varying one of said end limits comprise an adjusting ring, the inflow edges and the pivot axles of the guide blades are disposed a greater radial distance than the free end of the guide blades from said rotor axle, said adjusting ring is rotatable about said rotor axle and carries contact surfaces for free ends of said guide blades which contact surfaces are spaced a lesser radial distance than said guide blade pivot axles from said rotor axle, and the free ends of said guide blades are supported by said contact surfaces of said adjusting ring in the radially inward direction of said rotor axle and are freely pivotable around said guide blade pivot axles in the radially outward direction of said rotor axle.

2. A variable control mechanism according to claim 1, wherein said turbine engine comprises an exhaust gas turbine of a turbocharger.

3. A variable control mechanism according to claim 1, wherein said turbine engine comprises a centripetal flow rotor.

4. A variable control mechanism according to claim 1, wherein said turbine engine comprises an axial flow rotor.

5. A variable control mechanism according to claim 1, wherein said control mechanism is disposed within a flow channel of said turbine engine.

6. A variable control mechanism according to claim 5, wherein said control mechanism comprises an adjusting ring arranged in a flow channel of said turbine engine rotatable around the axis of said rotor.

7. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein each guide blade is provided with a lateral rod which engages an adjustable guide groove, the end limits of said angular range being determined by the adjustment of said groove.

8. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, said means for varying one of said end limits comprising an adjusting ring, and wherein said adjusting ring forms a part of a flow channel wall and is provided with projecting sawtooth form contact surfaces for free ends of the guide blades.

9. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, said turbine engine comprising an axial flow rotor, and wherein the free ends of said guide blades rest in part on an adjusting ring formed as a hollow ring and arranged in the flow channel in an axially movable manner.

10. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein at least two of said guide blades are coupled with each other and pivot together.

11. A variable control mechanism according to claim 10, wherein said at least two guide blades are coupled by means of a lever.

12. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein said control mechanism comprises an adjusting ring arranged in a flow channel of said turbine engine and rotatable around the axis of said rotor, and contact surfaces are formed on said adjusting ring for free ends of the pivotable guide blades, said contact surfaces preventing further pivotable motion of said guide blades when engaged by the free ends of said guide blades.

13. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein said control mechanism comprises an adjusting ring arranged in a flow channel of said turbine engine and rotatable around the axis of said rotor, and said adjusting ring is provided around its circumference with a series of radially outwardly projecting cam portions, the radially outward surfaces of said cam portions serving as contact surfaces for free ends of said guide blades.

14. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein said control mechanism comprises an adjusting ring arranged in a flow channel of said turbine engine and rotatable around the axis of said rotor, said turbine engine comprises an axial flow engine, said adjusting ring is selectively movable in the axial direction, and an axial end face of said adjusting ring serves as a contact surface for free ends of said guide blades.

15. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein said control mechanism comprises an adjusting ring arranged in a flow channel of said turbine engine rotatable around the axis of said rotor, said adjusting ring is provided with a guide groove for each guide blade, and each guide blade is provided with a guide rod received within an associated guide groove, the end limit of possible pivotable motion of each guide blade being variable by moving said control ring to adjust the position of the associated guide groove.

16. A variable control mechanism for a turbine engine having a ring of guide blades arranged concentrically around a rotor, said guide blades being freely pivotable under the influence of applied flow forces between end limits, said control mechanism comprising means for varying one of said end limits to adjust the angular range of freely pivotable motion of said guide blades between said end limits, wherein said means for varying one of the end limits comprises an adjusting ring, and said adjusting ring is rotatably arranged concentrically around the rotor of said turbine engine and forms a sidewall portion of a gas flow channel of said engine.

* * * * *